US005666681A

United States Patent [19]

Meyer et al.

[11] Patent Number: 5,666,681

[45] Date of Patent: Sep. 16, 1997

[54] HEEL PRESSURE MANAGEMENT APPARATUS AND METHOD

[75] Inventors: Eric R. Meyer, Greensburg; Greg W. Branson, Batesville; Richard J. Schuman, Brookville; David J. Ulrich, Sunman, all of Ind.

[73] Assignee: Hill-Rom, Inc., Batesville, Ind.

[21] Appl. No.: 367,829

[22] Filed: Jan. 3, 1995

[51] Int. Cl.[6] ..... A47C 27/08; A47C 27/10

[52] U.S. Cl. ..... 5/727; 5/710; 5/713; 5/624; 5/937

[58] Field of Search ..... 5/624, 648, 937, 5/710, 713, 715, 727

[56] References Cited

U.S. PATENT DOCUMENTS

| | | |
|---|---|---|
| 3,678,520 | 7/1972 | Evans . |
| 3,822,425 | 7/1974 | Scales . |
| 4,193,149 | 3/1980 | Welch . |
| 4,225,989 | 10/1980 | Corbett et al. . |
| 4,542,547 | 9/1985 | Sato . |
| 4,694,520 | 9/1987 | Paul et al. . |
| 4,797,962 | 1/1989 | Goode . |
| 4,803,744 | 2/1989 | Peck et al. . |
| 4,838,309 | 6/1989 | Goodwin . |
| 4,873,737 | 10/1989 | Savenije . |
| 4,949,414 | 8/1990 | Thomas et al. . |
| 5,201,713 | 4/1993 | McClure . |
| 5,235,713 | 8/1993 | Guthrie et al. . |

FOREIGN PATENT DOCUMENTS

| | | |
|---|---|---|
| 584809 | 10/1959 | Canada . |
| 0 218 301 | 4/1987 | European Pat. Off. . |
| 0 341 570 | 11/1989 | European Pat. Off. . |
| 0 485 362 | 5/1992 | European Pat. Off. . |
| 0 489 310 | 6/1992 | European Pat. Off. . |
| 2 169 195A | 7/1986 | United Kingdom . |
| WO91/11617 | 8/1991 | WIPO . |

OTHER PUBLICATIONS

"Akrotech 4000" brochure, Lumex, 1992.

*Primary Examiner*—Flemming Saether
*Attorney, Agent, or Firm*—Barnes & Thornburg

[57] ABSTRACT

A sleep support surface includes a mattress having at least two bladders located adjacent a foot end. The bladders each have a predetermined, adjustable internal pressure. The pressure in at least one of the bladders is selectively and independently reduced to provide pressure relief on the heels of the patient lying on the mattress. The pressure in a bladder located toward the head end of the mattress and adjacent the at least one bladder is increased. This pressure increase advantageously provides the lifting force under the calves of the patient to reduce further pressure on the patient's heels. A visual indication of the location each of the at least two bladders in the mattress is provided to facilitate selection of the at least one bladder in which to reduce pressure during the pressure reducing step, thereby providing pressure relief on the heels of the patient lying on the mattress. The at least one bladder in which to reduce the pressure is selected based on a position of the patient's heels on the mattress relative to the visual indication of the location of each of the bladders.

20 Claims, 2 Drawing Sheets

HEEL PRESSURE MANAGEMENT APPARATUS AND METHOD

BACKGROUND AND SUMMARY OF THE INVENTION

The present invention relates to an improved sleep support surface for a hospital bed. More particularly, the present invention relates to a bed including a mattress having a plurality of bladders having adjustable internal pressures and a control system for altering the firmness or pressure in selected bladders to control the amount of pressure applied to heels of a patient lying on the bed.

Certain individuals who are confined to bed for an extended period of time are vulnerable to skin breakdown on the back of the heel. Protection of the skin in this area is important if initial indications of tissue failure are observed. If the breakdown process has progressed to a point of ulceration, protection of the heel area of the patient is essential to healing.

Reducing or eliminating the time an individual spends in a supine position will protect the heel area, although it may increase the risk of skin failure on other areas of the foot and body. The current practice for protecting the heel area of a patient while in the supine position utilizes means for supporting the foot to reduce or eliminate pressure and shear on the back of the heel. Such support is often provided by placing an ordinary pillow or folded towel under a calf area of the patient's legs. Several different foam boot designs are known that strap to the leg or foot to reduce the effects of heel pressure. In addition, a conventional mattress is known in which removable sections are provided in a foot area. All of these conventional support methods require a caretaker to add or remove components from the bed in order to control pressure on the heels of the patient. Components which are removed from the bed have the potential to get lost or mislaid. Components that are added to the bed provide an extra cost associated with the purchasing, cleaning, and disposal of the added components. There is also a cost in time for the caregiver who must go through multiple steps to initiate and maintain the support of the device.

The present invention relates to an improved apparatus and method for providing protection to the back of the patient's heels against skin damage. Advantageously, the present invention integrates a suspension system for the foot into the mattress of the bed. A single step by the caregiver activates the suspension system. Advantageously, no components are required to be added or removed from the bed in order to reduce pressure on the patient's heels. The suspension system of the present invention does not require removal of bed linens or disassembly of the mattress.

The suspension system of the present invention automatically transfers support of the foot to the calf so that pressure and shear forces on the back of the heel are reduced or eliminated. Transfer of support occurs either by providing a lifting force on the calf, a depression under the foot, or both. The heel pressure control apparatus and method of the present invention can be deactivated so that the mattress functions as normal. The mattress area not committed to the suspension system of the present invention may be of any design, including inner-spring, foam, water, or air support. To accommodate individuals who are different heights, or lying in different locations on the mattress, the system of the present invention advantageously provides multiple zones for controlling the pressure on the heel area. The caregiver can select whichever zone provides optimal suspension based on the location of the individual's feet on the mattress.

Labels or other visual indicia are provided on a frame of the bed to facilitate selection of an appropriate zone by the caregiver. Preferably, a zone label is provided beneath each heel pressure control zone in the mattress. Since the entire heel zone pressure control apparatus is located inside the mattress, these labels provide an external, visible indication of the location of each zone.

In a preferred embodiment, the mattress includes a series of air bladders located in a foot end. Internal pressure in the chambers under the calf is increased to provide lift at the calf. A depression is simultaneously created under the foot by deflating the air chambers in the foot area. The air chambers are encased with the rest of the mattress support system in foam, which is in turn encased in ticking. Therefore, the mattress incorporating the heel management apparatus of the present invention functions and appears like a conventional mattress. Normal size bedding may be used.

According to one aspect of the present invention, a sleep support surface includes a mattress having at least two bladders located adjacent a foot end. The bladders each have a predetermined, adjustable internal pressure. The sleep support surface also includes a pressure controller configured to reduce the pressure in at least one selected bladder independently from the remaining bladders to provide pressure relief on heels of a patient lying on the mattress above the at least one selected bladder.

In the illustrated embodiment, the pressure controller further includes means for increasing the pressure in a bladder located adjacent the at least one selected bladder and located toward the head end of the mattress. This pressure increase advantageously provides the lifting force on the calves of the patient to further reduce pressure on the patient's heels.

Also in the illustrated embodiment, the pressure controller includes a pressure sensor and an air line coupled to each of the bladders, and an air pump coupled to the air line to deflate the at least one selected bladder to a pressure of about zero psi. The pressure controller also includes means for adjusting an air volume within the at least one selected bladder at predetermined time intervals to maintain the air volume within the at least one selected bladder at about 90% or greater of the total volume of the at least one selected bladder. Illustratively, the adjusting means includes means for inflating the at least one selected bladder to a predetermined pressure at which the sensor can accurately measure the pressure in the at least one selected bladder, and means for deflating the at least one selected bladder back to about zero psi.

According to another aspect of the present invention, a bed includes a mattress having a head end and a foot end. The mattress includes a plurality of bladders. The bladders each have an independently adjustable internal pressure. The bed also includes a frame for supporting the mattress, and a visual indicia located on the frame beneath at least two of the bladders Adjacent the foot end of the mattress to provide a visual indication of the location of each of the at least two bladders in the mattress. The bed further includes a pressure controller for selectively reducing pressure in at least one of the bladders located adjacent the foot end of the mattress based on the location of heels of a patient lying on the mattress relative to the visual indicia on the frame to provide pressure relief for on the heels of the patient.

In the illustrated embodiment, the pressure controller includes a pressure sensor coupled to each of the plurality of bladders and means for coupling the pressure sensor to the pressure controller. The pressure controller further includes an air manifold having a plurality of air outlets. Each air outlet is coupled to one of the plurality of bladders by an air line. The air manifold also has an outlet coupled to an air flow direction valve. The pressure controller further includes an air pump coupled to the air flow direction valve for selectively inflating and deflating the plurality of bladders independently.

Illustratively, the pressure controller further includes means for adjusting the volume in the at least one bladder having reduced pressure at a predetermined time interval to maintain the volume of air within the at least one bladder at about 90% or greater of the total volume of the at least one bladder. The adjusting means includes means for inflating the at least one bladder to a predetermined pressure at which a pressure sensor can accurately measure the pressure in the at least one bladder, and means for deflating the at least one bladder back to about zero psi.

According to yet another aspect of the present invention, a method is illustrated for providing pressure relief on heels of a patient lying on a bed. The method includes the steps of providing a mattress including at least two bladders located adjacent a foot end. The bladders each have a predetermined, adjustable internal pressure. The method also includes the step of selectively and independently reducing the pressure in at least one of the bladders to provide pressure relief on the heels of the patient lying on the mattress.

The illustrated method further includes the step of increasing the pressure in a bladder located toward the head end of the mattress and adjacent the at least one bladder in which the pressure was reduced during the reducing step. This pressure increase advantageously provides the lifting force under the calves of the patient to reduce further pressure on the patient's heels.

The method still further includes the step of providing a visual indication of the location each of the at least two bladders in the mattress to facilitate selection of the at least one bladder in which to reduce pressure during the pressure reducing step, thereby providing pressure relief on the heels of the patient lying on the mattress. The illustrated method includes the step of selecting which of the at least two bladders to reduce the pressure in the reducing step based on a position of the patient's heels on the mattress relative to the visual indication of the location of each of the bladders.

In one illustrated method, the at least two bladders are air filled bladders, and the reducing step includes the step of deflating the selected at least one bladder to a pressure of about zero psi. The method includes the step of adjusting an air volume within the at least one deflated bladder at a predetermined time interval to maintain the air volume within the at least one deflated bladder at about 90% or greater of the total volume of the at least one deflated bladder. The adjusting step includes the steps of inflating the at least one bladder to a predetermined pressure at which the pressure inside the at least one bladder can be accurately measured, and then deflating the at least one bladder back to about zero psi.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
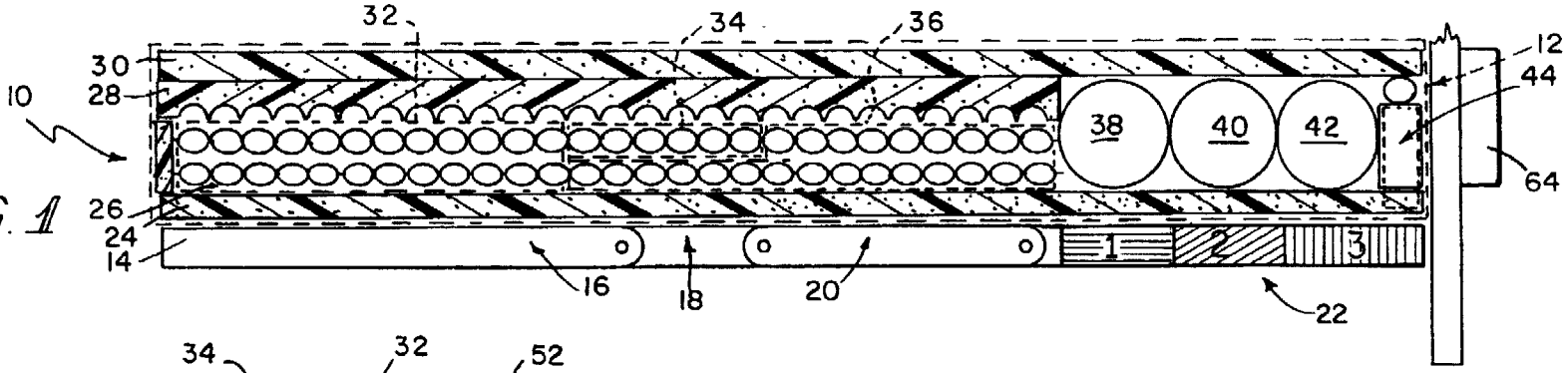
FIG. 1 is a diagrammatical view of a bed of the present invention illustrating a sectional view of a preferred embodiment of the mattress including three bladders adjacent a foot end of the mattress for controlling pressure relief for heels of a patient lying on the mattress and illustrating a frame for supporting the mattress including labels on the frame corresponding to the position of each of the three heel bladders within the mattress.

Referring now to the drawings, FIG. 1 illustrates a hospital bed 10 including a mattress 12 and an articulation frame or deck 14. Mattress 12 and frame 14 include a head zone 16, a seat zone 18, a knee zone 20, and a foot zone 22. Mattress 12 includes a bottom foam section 24, a plurality of air bladders 26, a scalloped topper foam section 28, and a ticking section 30. The plurality of air bladders 26 are controlled in six separate pressure zones. A head bladder 32 includes a plurality of separate interconnected chambers located adjacent head zone 16 of bed 10. A seat bladder 34 includes a plurality of interconnected chambers located adjacent seat zone 18 of bed 10. A knee bladder 36 includes a plurality of interconnected chambers located adjacent knee zone 20 of bed 10. Three separate heel bladders 38, 40 and 42 are located adjacent foot zone 22 of bed 10. Bladder 38 provides a top heel zone bladder, bladder 40 provides a middle heel zone bladder, and bladder 42 provides a bottom heel zone bladder. Advantageously, inflation and deflation of heel bladders 38, 40 and 42 is controlled separately and independently. Therefore, top heel bladder 38, middle heel bladder 40, and bottom heel bladder 42 can be selectively inflated and deflated to provide a heel pressure management apparatus to provide protection against skin damage to the back of a patient's heels. Advantageously, heel bladders 38, 40 and 42 are all located inside mattress 12. There is no need to add or remove components from mattress 12 in order to provide heel protection for the patient.

As illustrated in FIG. 1, articulation frame 14 is provided with three separate labeled areas in foot zone 22 of bed 10. Since the heel zone bladders 38, 40 and 42 are located within mattress 12, the caregiver cannot visually inspect the location of each of the heel zones provided by heel bladders 38, 40 and 42. Therefore, labels 1, 2 and 3 provide a visual indication of three separate heel zones 38, 40 and 42, respectively, of bed 10. Label 1 provides a visual indication of the location of top heel bladder 38 within bed 10. Label 2 provides a visual indication of the location of middle heel bladder 40 within bed 10. Label 3 provides a visual indication of the location of bottom heel bladder 42 within bed 10. Advantageously, the caregiver can identify the location of a patient's heels on bed 10 using the three labels 1, 2 and 3. After the location is identified, the caregiver can press an appropriate switch located on a footboard control panel 64 to deflate selectively the appropriate heel bladders 38, 40, and 42 beneath the patient's heels, thereby reducing pressure on the patient's heels as discussed below in detail.

Often, when the head zone 16 of bed 10 is raised, the patient will gravitate toward foot zone or end 22 of bed 10. The present invention facilitates adjustment of the heel pressure management system. If the caregiver detects that the location of the patient's heels have moved relative to the mattress 12, the caregiver selects a different heel zone to deflate using the appropriate label indication 1, 2 or 3 on frame 14. By pressing a switch for a different heel zone on the footboard control panel 64, the caregiver may change the inflation or deflation of the various heel bladders 38, 40 and 42. Advantageously, the bed 10 therefore accommodates patients having various heights and also accommodates any movement of the patient on the bed.

Figure 2:
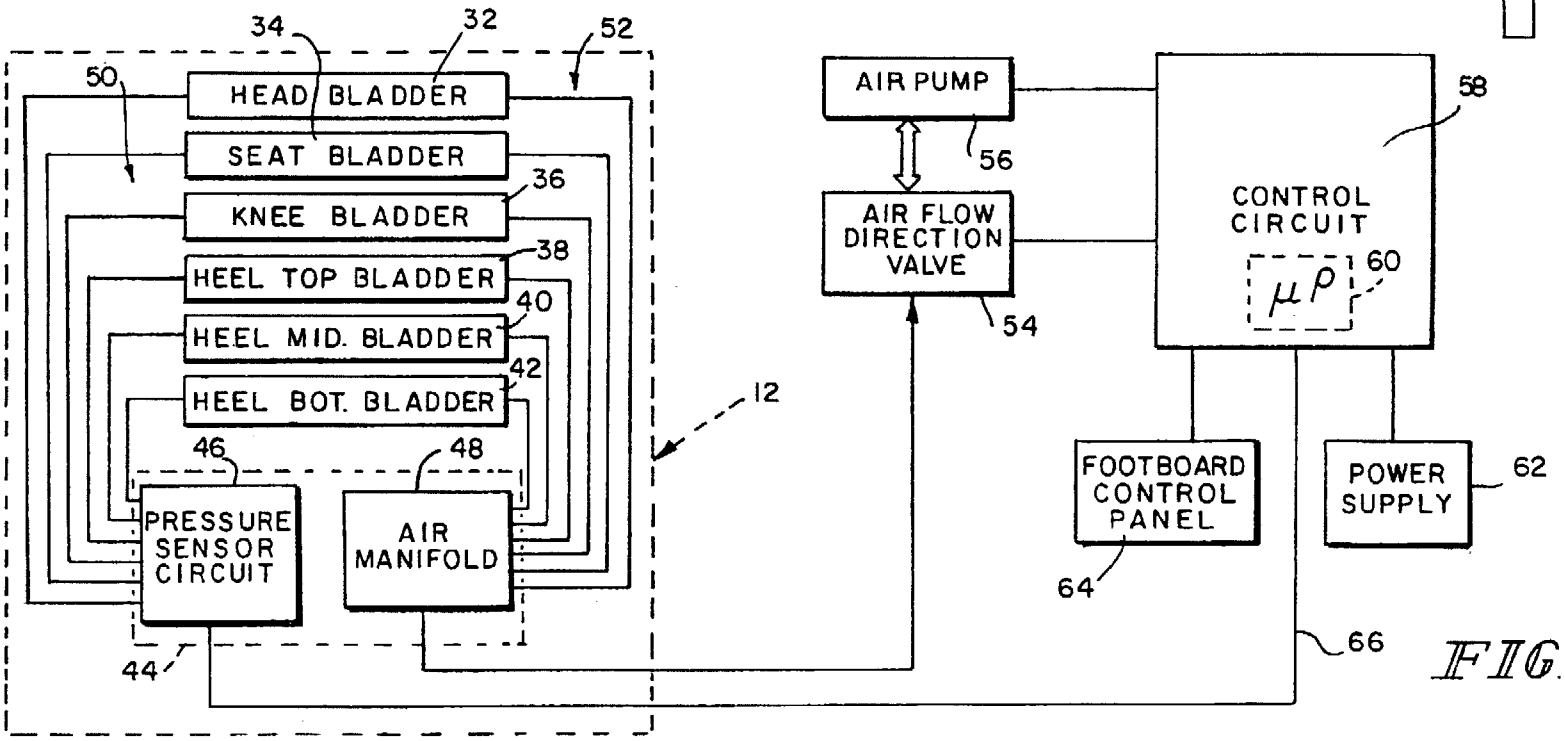
FIG. 2 is a diagrammatical view illustrating a control system for the heel zone control apparatus including a control circuit for controlling pressure in each bladder of the mattress.

Control of the various air bladders 32, 34, 36, 38, 40 and 42 of bed 10 is illustrated in FIG. 2. A valve module 44 is preferably located adjacent foot end 22 of bed 10 within the mattress 12. The valve module 44 includes a pressure sensor board 46 and an air manifold 48. Sensor board 46 includes six pressure sensors, one pressure sensor being coupled to each of the six bladders 32, 34, 36, 38, 40 and 42 by air lines 50. Air manifold 48 includes a plurality of air lines 52, with one air line 52 being coupled to each of the six bladders 32, 34, 36, 38, 40 and 42.

Air manifold 48 is also coupled to an air flow direction valve 54 housed externally of mattress 12 on bed 10. Air flow direction valve 54 is coupled to an air pump 56. Air flow direction valve 54 and air pump 56 are controlled by a control circuit 58 including a microprocessor 60 which is programmed with software to control operation of the present invention. Pressure sensor circuit 46 also includes appropriate memory for storing all the data and optimum pressure values discussed below. A power supply 62 is coupled to control circuit 58 to provide power to the apparatus of the present invention. A footboard control panel 64 is also provided for controlling operation of the present invention by pushing different switches on footboard control panel 64. Although a control panel is shown on a footboard 64 of bed 10, it is understood that the control panel could be at any location, either attached to or remote from bed 10.

The apparatus of the present invention provides an air inflated, multifunctional, automatic and/or user controlled sleep surface used in conjunction with hospital patient beds. The functions of the apparatus are separated into several modes of operation. In the illustrated embodiment, three different Heel Management modes are provided are provided to reduce heel-to-mattress interface pressure. Advantageously, the Heel Management modes accommodate a wide range of patient heights.

Communications between the control circuit 58 and the footboard 64 is via LON communications protocol through a single pair of wires utilizing RS485 medium standard. Communications between the control circuit 58 and the pressure sensor circuit 46 is via a 25 pin D-sub cable 66 utilizing 3-wire synchronous serial bidirectional communications along with other discrete lines and AC and DC power.

Essentially all "intelligent" communications and control of bed 10 is performed by the control circuit 58. The microprocessor 60 performs calculations on signals received from sensor circuit 46 and transfers various control signals to air pump 56, air flow direction valve 54, and air manifold 48 to control pressure within bladders 32, 34, 36, 38, 40 and 42.

As discussed above, the Heel Management modes permit a caregiver to adjust pressure in the bed 10 quickly to relieve pressure on heels of a bedridden patient. The heel management control apparatus and method of the present invention are configured to transfer support of the patient's foot to a calf of the patient so the pressure and shear forces on the back of the heel are reduced or eliminated. Transfer of support occurs either by providing a lifting force on the calf, a depression under the foot, or both. There are three different Heel Management Modes in bed 10 for controlling heel zone bladders 38, 40 and 42 selectively and independently to reduce pressure on a patient's heels. It is understood that more or less bladders may be controlled in the heel zone in accordance with the present invention. Advantageously, the three different modes are all incorporated into mattress 12. There is no requirement to add or remove components from mattress 12. The three different Heel Management Modes selectively deflate at least one of the heel bladders 38, 40 and 42 by pressing an appropriate heel zone pressure relief switch on footboard 64. The caregiver first makes a visual inspection of the location of the patient's heels in foot zone 22 of bed 10. For instance, if the patient's heels lie in zone 2, the caregiver will press the heel pressure relief switch for heel zone 2.

Figure 3:
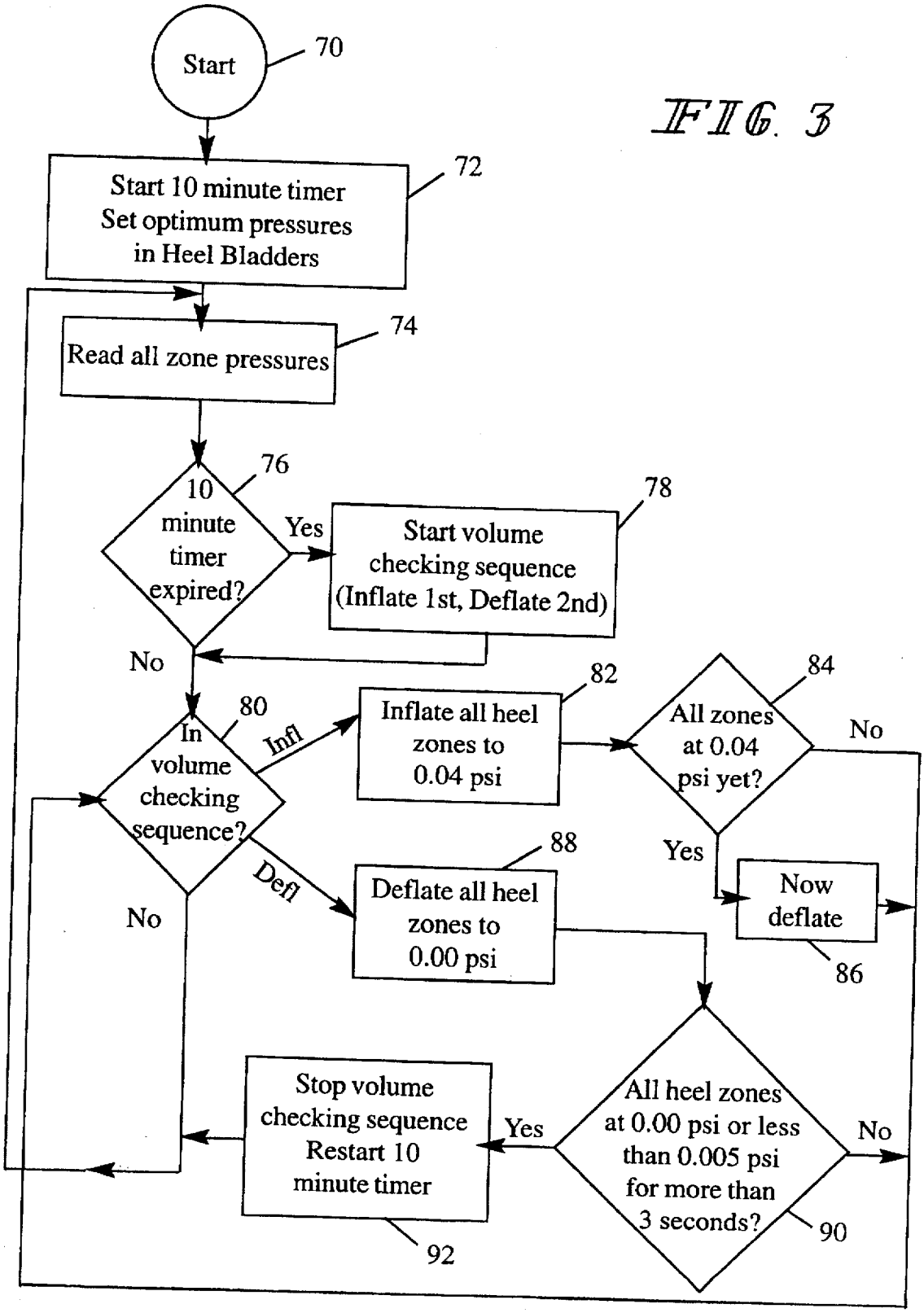
FIG. 3 is a flow chart of the steps performed by the control circuit to adjust the pressure in selected heel zones and to check the air volume in the deflated heel zones at a predetermined time interval.

Details of the steps performed by control circuit 58 during the Heel Management Mode are illustrated in FIG. 3. The Heel Management Mode starts at block 70. Control circuit 58 starts a ten minute timer and sets optimum pressures in all three heel bladders 38, 40, and 42 as illustrated at block 72. Preferably, the pressure in each heel bladder 38, 40, and 42 is initially set at about 0.1 psi.

While in a selected Heel Management Mode, certain heel bladders 38, 40 or 42 are deflated to about zero psi pressure, depending on which of the three Heel Management Modes is selected. Pressures are then regulated at predefined trim points. These predefined trim points and their pressure bands are different for each of the three heel zones.

If the patient's heels are located in zone 1 as illustrated by label 1 in FIG. 1, the first Heel Management Mode is selected. The optimum preset trim points in the first Heel Management Mode are as follows:

Heel Top Bladder: 0.001+0.019, −0.001 psi

Heel Mid Bladder: 0.001+0.019, −0.001 psi

Heel Bot Bladder: 0.001+0.019, −0.001 psi

Therefore, in the first Heel Management Mode when the patient's heels are aligned over zone 1 indicated by label 1, all three heel bladders 38, 40, and 42 are deflated to about 0 psi. This pressure drop advantageously reduces pressure on the patient's heels.

If the patient's heels are located in zone 2 as illustrated by label 2 in FIG. 1, the second Heel Management Mode is selected. The optimum preset trim points in the second Heel Management Mode are as follows:

Heel Top Bladder: 0.250±0.025 psi

Heel Mid Bladder: 0.001+0.019, −0.001 psi

Heel Bot Bladder: 0.001+0.019, −0.001 psi

Therefore, when the patient's heels lie in zone 2 indicated by label 2 in FIG. 1, both the middle heel bladder 40 and bottom heel bladder 42 are deflated to about 0 psi to produce pressure on the heels of the patient. Top heel bladder 38 is increased in pressure from about 0.100 psi to about 0.250 psi to provide a lifting force under the calves of the patient.

If the patient's heels are located in zone 3 as illustrated by label 3 in FIG. 1, the third Heel Management Mode is selected. The optimum preset trim points in the third Heel Management mode are as follows:

Heel Top Bladder: 0.250±0.025 psi

Heel Mid Bladder: 0.250±0.025 psi

Heel Bot Bladder: 0.001+0.019, −0.001 psi

Therefore, when the patient's heels are aligned over zone 3 indicated by label 3 in FIG. 1, the pressure in heel bladder 42 is reduced to about 0 psi pressure to reduce force on the heels of the patient. Pressure in the top heel bladder 38 and middle heel bladder 40 is increased from about 0.100 psi to about 0.250 psi to provide a lifting force under the calves of the patient.

When in the Heel Management Mode, the predetermined air bladder 38, 40, or 42 under the patient's heels along with any other bladders toward foot end 22 of bed 10 are deflated to approximately 0 psi pressure. Pressure in an adjacent bladder located toward the head end of bed 10 is preferably increased slightly to provide a lifting force under the patient's calves.

FIG. 3 illustrates operation of the invention in any of the three Heel Management Modes. Control circuit 58 reads all zone pressures from pressure sensor circuit 46 as illustrated at block 74. Control circuit 58 then determines whether the ten minute timer has expired at block 76. If the ten minute timer has expired, the control circuit 58 automatically initiates a volume checking sequence which first inflates and then deflates all the deflated heel zone bladders 38, 40 or 42.

The heel bladders 38, 40 and 42 with near zero psi pressure present a unique problem in that 0.000 psi is within the tolerance. However, the volume of air in the bladder 38, 40 or 42 at zero psi pressure is required to be maintained at more than 90% of full volume. Therefore, volume checking steps are performed by the apparatus to ensure the volume of air in each bladder 38, 40, or 42 at zero psi does not fall below 90% of a total volume level for more than 10 minutes.

When the ten minute timer expires, the deflated heel zones are first inflated to a higher, reliably readable pressure and then immediately deflated back to the trim points defined above. Illustratively, this higher, reliably readable pressure is about 0.04 psi. It is understood that another pressure may be used depending on the sensitivity of the sensors in pressure sensor circuit 46. In the first Heel Management Mode, all three heel bladders 38, 40, and 42 are controlled in the volume checking sequence of block 78. In the second Heel Management Mode, middle heel bladder 40 and bottom heel bladder 42 are controlled in the volume checking sequence at block 78. Finally, in the third Heel Management Mode, only the bottom heel bladder 42 is checked and controlled during the volume checking sequence at block 78. The volume checking sequence begins at block 80. As discussed above, each deflated zero psi heel bladder 38, 40 or 42 is first inflated to about 0.04 psi as illustrated at block 82. This is about the minimum pressure which provides a reliably readable pressure for sensor circuit 46. Control circuit 58 determines whether all the appropriate deflated zones are at 0.04 psi at block 84. If all the deflated bladders are not at 0.04 psi, control circuit 58 returns to block 80 and continues inflation of the appropriate deflated bladders 38, 40 or 42. If all the deflated zones are at 0.04 psi at block 84, control circuit 58 initiates the deflate mode as illustrated at block 86. Control circuit 58 stays in the volume checking sequence at block 110 and begins deflation of all the deflated heel zones to the 0.00 psi pressure as illustrated at block 88. Control circuit 58 determines whether all deflated heel zones or bladders 38, 40 or 42 are at 0.0 psi or at less than 0.005 psi for more than three seconds at block 90. If not, control circuit 58 returns to block 80 and continues deflation of the heel zones. If all the heel zones are at 0.00 psi or at less than 0.005 psi for more than three seconds, control circuit 58 stops the volume checking sequence and restarts the ten minute timer as illustrated at block 92. This volume checking sequence advantageously maintains each deflated bladder 38, 40 and 42 filled to at least 90% of its total volume.

Another problem arises because of this low pressure maintenance requirement. Small voltage drifts in the pressure sensing circuit 46 may result in the 0.000 psi calibration stored in an EEPROM during manufacture to later become a slightly negative pressure. The control circuit would then fully deflate the heel zone to the point where the pressure is negative. This would violate the requirement that the volume in the deflated bladders 38, 40, or 42 remain more than 90% of the total volume. Therefore, during deflation of the low pressure heel zones, when the pressure drops below approximately 0.022 psi, the control circuit 58 starts a three second timer. The controller then stops deflating the zone if the pressure reaches the calibration point or if the three second timer expires.

Although the invention has been described in connection with the use of air bladders, it is understood that the control circuit could be used to control pressure within bladders 32, 34, 36, 38, 40 and 42 with gas or fluid instead of air. In addition, a mechanical support apparatus including a plurality of movable support members defining the various zones may be provided in foot zone 22 to relieve pressure on the heels of a patient.

It is also understood that the components of the present invention which are mounted on the bed or frame can be portable and configured to be mounted on any bed and frame. Therefore the sleep support surface of the present invention is modular and can be used on any bed or frame. Separate labels 1, 2, and 3 may also be provided to be attached to any bed or frame.

Although the invention has been described in detail with reference to a certain preferred embodiment, variations and modifications exist within the scope and spirit of the present invention as described and defined in the following claims.

What is claimed is:

1. A sleep surface system comprising:

a mattress including at least two bladders located adjacent a foot end, the bladders each having a predetermined, adjustable internal pressure; and a pressure controller configured to reduce the pressure in at least one selected bladder independently from the remaining bladders to provide pressure relief on heels of a patient lying on the mattress when the heels are located above the at least one selected bladder, the pressure controller including a pressure .sensor and an air line coupled to each of the bladders and an air pump coupled to the air line to deflate the at least one selected bladder to a pressure of about zero psi, the pressure controller also including means for adjusting an air volume within the at least one selected bladder at a predetermined time interval to maintain the air volume within the at least one selected bladder at about 90% or greater of a total air volume of the at least one selected bladder.

2. The sleep surface system of claim 1, further comprising a frame for supporting the mattress, and at least two heel zone labels located on the frame, each heel zone label providing a visual indication of the location of one of the bladders in the mattress to facilitate selection of the at least one bladder in which to reduce pressure to provide pressure relief for on heels of a patient lying on the mattress.

3. The sleep surface system of claim 1, wherein the adjusting means includes means for inflating the at least one selected bladder to a predetermined pressure at which the sensor can accurately measure the pressure in the at least one selected bladder, and means for deflating the at least one selected bladder back to about zero psi.

4. The sleep surface system of claim 1, further comprising means for increasing the pressure in a bladder located adjacent the at least one selected bladder and located toward a head end of the mattress.

5. A method for providing pressure relief on heels of a patient lying on a bed, the method comprising the steps of:

providing a mattress including at least two air filled bladders located adjacent a foot end, the bladders each having a predetermined, adjustable internal pressure;

selectively and independently reducing the pressure in at least one of the bladders to provide pressure relief on the heels of the patient lying on the mattress, the reducing step including the step of deflating the selected at least one bladder to a pressure of about zero psi; and adjusting an air volume within the at least one deflated bladder to maintain the air volume within the at least one deflated bladder at about 90% or greater of the total volume of the at least one deflated bladder.

6. The method of claim 5, further comprising the step of providing a visual indication of the location each of the at least two bladders in the mattress to facilitate selection of the at least one bladder in which to reduce pressure during the pressure reducing step, thereby providing pressure relief on the heels of the patient lying on the mattress.

7. The method of claim 6, further comprising the step of selecting in which of the at least two bladders to reduce the pressure in the reducing step based on a position of the patient's heels on the mattress relative to the visual indication of the location of each of the bladders.

8. The method of claim 5, wherein the adjusting step includes the steps of inflating the at least one bladder to a predetermined pressure at which the pressure inside the at least one bladder can be accurately measured, and then deflating the at least one bladder back to about zero psi.

9. The method of claim 5, further comprising the step of increasing the pressure in a bladder located toward a head end of the mattress and adjacent the at least one bladder in which the pressure was reduced during the reducing step.

10. A bed comprising:

a mattress having a head end and a foot end, the mattress including a plurality of bladders, the bladders each having an independently adjustable internal pressure;

a frame for supporting the mattress;

a visual indicia located on the frame beneath at least two of the bladders adjacent the foot end of the mattress to provide a visual indication of the location of each of the at least two bladders in the mattress; and a pressure controller for selectively reducing pressure in at least one of the bladders located adjacent the foot end of the mattress based on the location of heels of a patient lying on the mattress relative to the visual indicia on the frame to provide pressure relief for on the heels of the patient.

11. The bed of claim 10, wherein the pressure controller includes a pressure sensor coupled to each of the plurality of bladders and means for coupling the pressure sensor to the pressure controller.

12. The bed of claim 11, wherein the pressure controller further includes an air manifold having a plurality of air outlets, each air outlet being coupled to one of the plurality of bladders by an air line, the air manifold also having an outlet coupled to an air flow direction valve, the pressure controller further including an air pump coupled to the air flow direction valve for selectively inflating and deflating the plurality of bladders independently.

13. The bed of claim 10, wherein the pressure controller includes means for adjusting the volume in the at least one bladder having reduced pressure at a predetermined time interval to maintain an air volume within the at least one bladder at about 90% or greater of a total air volume of the at least one bladder.

14. The bed of claim 13, wherein the predetermined time interval is about ten minutes.

15. The bed of claim 13, wherein the adjusting means includes means for inflating the at least one bladder to a predetermined pressure at which a pressure sensor can accurately measure the pressure in the at least one bladder, and means for deflating the at least one bladder back to about zero psi.

16. A sleep surface system comprising:

a mattress including at least two bladders located adjacent a foot end, the bladders each having a predetermined, adjustable internal air pressure; and a pressure controller configured to reduce the pressure in at least one selected bladder independently from at least one remaining bladder to provide pressure relief on heels of a patient when the heels are located on the mattress above the at least one selected bladder, the pressure controller including a pressure sensor and an air line coupled to each of the bladders, an air pump coupled to each air line to deflate the at least one selected bladder to a pressure of about zero psi, and means for adjusting an air volume within the at least one selected bladder at a predetermined time interval to maintain the air volume within the at least one selected bladder at about 90% or greater of a total air volume of the at least one selected bladder.

17. The sleep surface system of claim 16, wherein the predetermined time interval is about ten minutes.

18. The sleep surface system of claim 16, wherein the adjusting means includes means for inflating the at least one selected bladder to a predetermined pressure at which the sensor can accurately measure the pressure in the at least one selected bladder, and means for deflating the at least one selected bladder back to about zero psi.

19. The sleep surface system of claim 16, further comprising means for increasing the pressure in a bladder located adjacent the at least one selected bladder and located toward a head end of the mattress.

20. The sleep surface system of claim 16, further comprising at least two heel zone labels configured to be positioned on a frame for supporting the mattress, each heel zone label providing a visual indication of the location of one of the bladders in the mattress to facilitate selection of the at least one bladder in which to reduce pressure to provide pressure relief for on heels of a patient lying on the mattress.

* * * * *